United States Patent [19]

Linnemann

[11] Patent Number: 4,898,279

[45] Date of Patent: Feb. 6, 1990

[54] WARP-FREE PAPERBOARD SLAT

[75] Inventor: Kent A. Linnemann, Cincinnati, Ohio

[73] Assignee: Shippers Paper Products Company, Loveland, Ohio

[21] Appl. No.: 139,472

[22] Filed: Dec. 30, 1987

Related U.S. Application Data

[63] Continuation-in-part of Ser. No. 946,858, Dec. 29, 1986, Pat. No. 4,771,885.

[51] Int. Cl.[4] ..... B65D 65/02; B65D 81/02

[52] U.S. Cl. ..... 206/586; 206/399; 206/443; 229/87 R; 229/DIG. 1; 428/121

[58] Field of Search ..... 206/320, 386, 521, 595–600, 206/483, 586, 399, 443; 229/23 A, 23 AB, 23 BT, 23 R, 199, 3.5 R, 87 R, DIG. 1; 428/121, 122, 124, 535

[56] References Cited

U.S. PATENT DOCUMENTS

| | | | |
|---|---|---|---|
| 1,063,845 | 6/1913 | Weiss | 229/199 |
| 1,988,453 | 1/1935 | Knowlton | 229/199 |
| 2,499,463 | 3/1950 | Crary | 428/121 |
| 2,575,898 | 11/1951 | Tadinger | 428/125 |
| 3,931,923 | 1/1976 | Thurston | 229/23 R |
| 4,399,915 | 8/1983 | Sorenson | 206/586 |

FOREIGN PATENT DOCUMENTS

| | | | |
|---|---|---|---|
| 0068590 | 8/1912 | Austria | 428/121 |

*Primary Examiner*—Jimmy G. Foster

*Attorney, Agent, or Firm*—Wood, Herron & Evans

[57] ABSTRACT

A paperboard slat for use in a variety of packaging and structural applications wherein a plurality of sheets of paperboard are laminated to each other and folded upon itself along a fold line with the facing sheets being adhered together. The slat is generally of extended length and has a rounded edge running along the fold line. The slat is characterized by its relatively high strength and rigidity and its substantially warp-free condition.

2 Claims, 3 Drawing Sheets

WARP-FREE PAPERBOARD SLAT

CROSS-REFERENCE TO RELATED APPLICATIONS

This application is a continuation-in-part of Ser. No. 946,858, filed Dec. 29, 1986, now Pat. No. 4,771,885.

BACKGROUND OF THE INVENTION

In a wide variety of applications wherein materials of one form or another are loaded, packaged and/or shipped it is desirable to provide structural reinforcement to the packaging assembly which may desirably include a degree of protection such as cushioning of the packaged load. In other applications it is desirable to provide a relatively rigid and warp-free paperboard member for constructing articles of relatively light weight and low cost which nevertheless possess the high strength and rigidity necessary for that particular application.

For example, in the shipment of a wide variety of materials and articles of manufacture, a pallet load of material often is accumulated and placed on a wooden skid or pallet such that it may be picked up and moved by a standard forklift truck. The load is secured to the pallet by means of tensioned high strength steel or plastic strapping passing over the load and down around the pallet. Material which is shipped in this manner spans a gamut from fine paper to printed products, such as newspapers, advertising inserts, and magazines, to boxed, cartoned or otherwise packaged goods, such as bottles, cans, and boxes. The range of different goods and applications handled in this manner is virtually limitless. In each case the load must be protected both from the force of the tensioned strapping itself passing over the edges of the load and damage from knocking, denting and abrasion with adjacent loads or with the truck or railroad car in which the load is shipped.

Protection of the load has been provided in the prior art by forming a wooden frame having a length and width generally corresponding to the length and width of the skid. The wooden frame is placed on the top of the load and the strapping passed over the edges. The use of wood has a number of disadvantages including the accumulation of dirt and the presence of moisture which can transfer to the load. Moreover, wood is heavy increasing the shipping weight, bulky taking into consideration room to store, unwielding making it hard to handle, and expensive. Further, the wood frames do not provide complete protection to the top of the load; and, even where a separate sheet or moisture barrier material is provided to protect the top of the load, provides no protection whatever to the sides of the load at the top edges.

Some shippers have substituted the use of rigid preformed paperboard angles for the wood frames. In this application, laminated paperboard which is glued, treated and formed into rigid right angles is either glued or stapled onto a frame which fits down around the top of the skid load. The single sheet of paperboard may be interposed between this frame and the top of the load to provide protection to the top of the load. The strapping is then passed over the right angle to secure the load to the skid. This particular form of corner protection has advantages over the use of a wood frame in that it cushions the load edges against hard knocks and strap indentation, replaces expensive lumber, and provides for some protection to the top edge of the load. On the other hand, the use of paperboard angles has a number of disadvantages in that additional labor is required to form the angles into a frame and handling problems are encountered in the moving and placing of that frame about the top of the skid load. All in all such angles are relatively unwielding to assemble and to place on the load and require additional labor.

In another application, it is often desired to protect the edges of a product which is inserted into a carton or strapped with bands. For example, in the shipment of doors it is desired to provide the side and top and bottom edges with protection extending about the edges and onto the opposing faces of the door such that straps do not cut into the edges. In this application is often desired to have a relatively high strength material protecting the door edges. Sheets of corrugated cardboard have been used in the past. However, that material is not of the desired requisite strength and is subject to crushing by the bands passing around the edges of the door.

In another application, it is desired to wrap a product, such as coils of wire or metal or bundles of rods, with a layer of wrapping to protect the exposed surfaces thereof but in addition to provide a strong, compression-resistant cover over the surface thereof.

In summary, there are a number of applications where it is desired to provide a high strength warp-free structural member having a high degree of rigidity and compression resistance which is nevertheless easy to manufacture and relatively inexpensive to produce.

SUMMARY OF THE INVENTION

To these ends, the present invention provides a relatively high strength, highly rigid, compression resistant warp-free paperboard slat which is relatively easy to manufacture and substantially more inexpensive and lighter in weight than corresponding wood slats which are often used to provide rigidity and structural strength in packaging applications. The warp-free slat of the present invention is formed by laminating a plurality of sheets of paperboard one to another with an adhesive therebetween to create a member having a thickness on the order of about 0.020 to 0.200". That laminate while still in a condition where the individual plies can slip with respect to each other is folded along one or more fold lines and the facing sheets are brought together and adhered together so that the faces are essentially co-extensive and fully adhered to each other. The resulting product which may be of indeterminate length and a desired width has at least one rounded edge along the fold line. The resulting paperboard slat has a thickness on the order of 0.040 to 0.25". Being made of paperboard it is relatively inexpensive to manufacture. Moreover it has been found that the resulting product has a high degree of strength, rigidity, and compression resistance and surprisingly is substantially warp-free whereby it can be used in a number of applications where relatively heavy, bulky, and rough wood slats have been used in the past.

Thus, the present invention provides a substantially improved and more useful warp-free paperboard article which is cleaner, lighter in weight, more economical to manufacture, and which provides better protection, strength, and rigidity than anything that has been heretofore available.

DETAILED DESCRIPTION OF THE INVENTION

Figure 1:
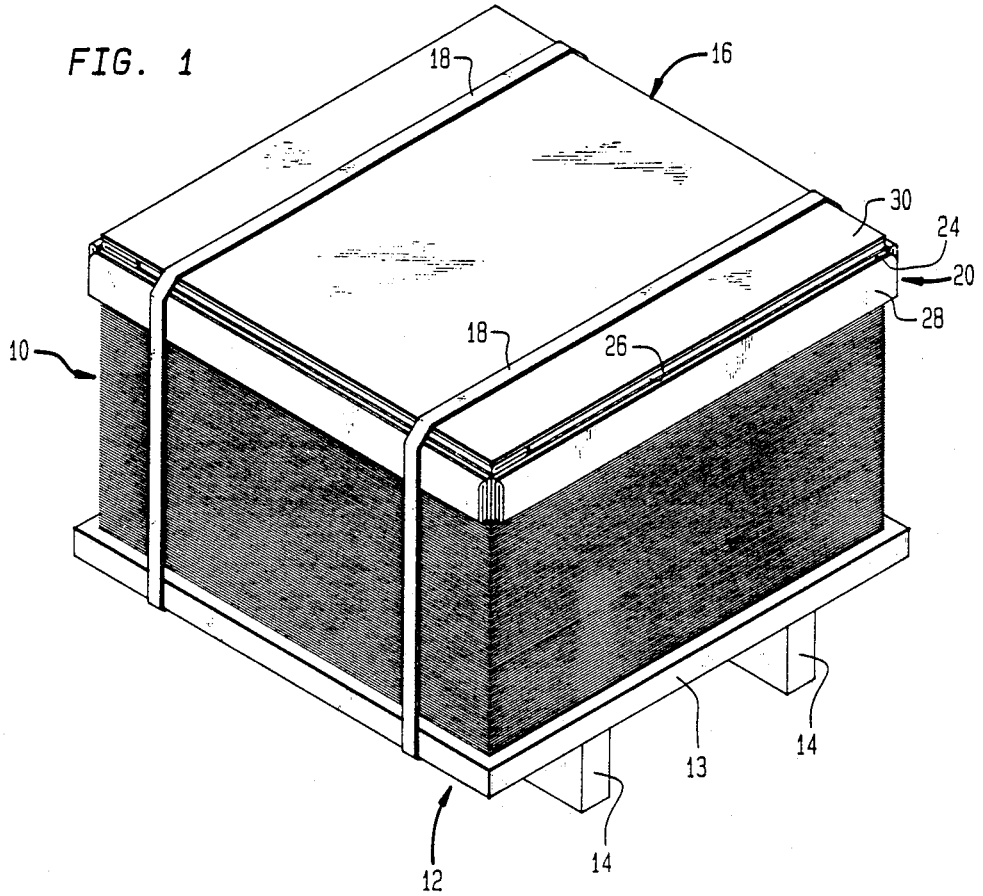
FIG. 1 is an isometric pictorial view illustrating one application of the warp-free paperboard slat of the present invention in forming a skid top.

For purposes of illustrating one potential application of the present invention, there is illustrated in FIG. 1 a skid load 10 of a stack of material such as a stack of fine paper. The paper is stacked on a wooden skid 12 which includes a pallet 13 and underlying wooden cross members 14 permitting the tines of a forklift truck to be inserted below the pallet 13 for lifting the skid load 10. A skid top 16 is placed on top of the stack of paper, and in the embodiment illustrated in FIG. 1, includes side flaps 20 which are bent down to cover and protect the top edges of the stack. Tension straps 18 pass over the skid top 16 and down around the skid load 10 to secure the skid top 16 and stack of paper tightly to the wooden skid 12.

Figure 2:
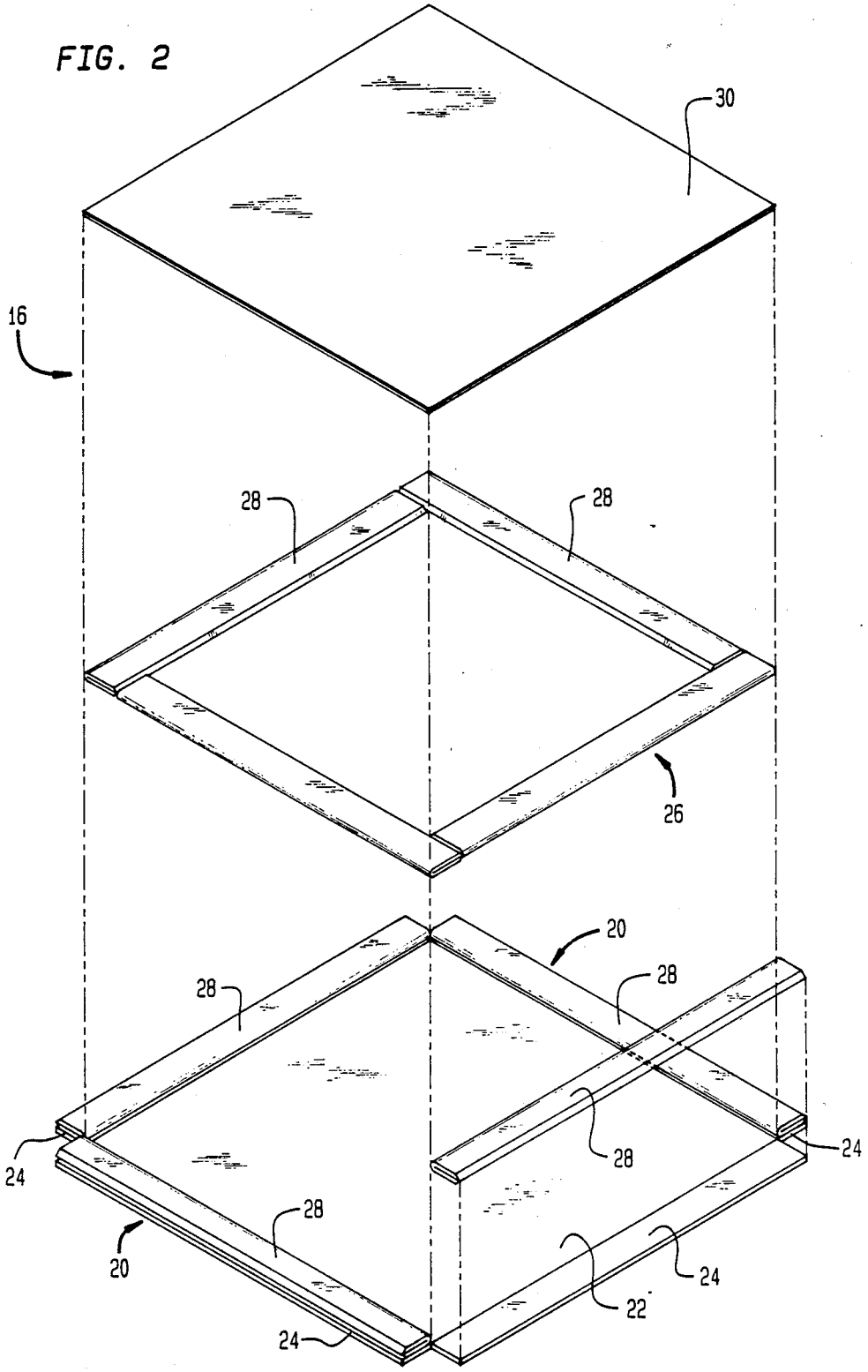
FIG. 2 is an exploded isometrical pictorial view showing the construction of the skid top shown in FIG. 1.

Referring in addition to FIG. 2, the skid top 16 includes a paperboard sheet 22 having an overall planar dimension generally corresponding to the length and width of the skid load upon which it is used. The paperboard sheet includes four side portions 24 integrally hinged thereto to which paperboard slats 28 of the present invention hereinafter described are glued to form the side flaps 20 adapted to be bent downwardly around the top of the load as shown in FIG. 1. A peripheral frame 26 is formed of the paperboard slats 28 of the present invention. These slats are laminated to the top of the paperboard sheet 22 around a peripheral edge to form the rigid frame 26. That is, the individual slats 28 are adhered to the surface of the sheet 22. A top paperboard sheet 30 having generally the same dimension as the bottom sheet 22 is then placed upon the frame 26 between two sheets of paperboard 22, 30. The slat frame 26 substantially strengthens and rigidifies the top member formed of the sheets 22 and 30. Likewise, the paperboard slats 28 are adhered to the side flap portions 24 to substantially reinforce the side flap portions 24.

Figure 4A:
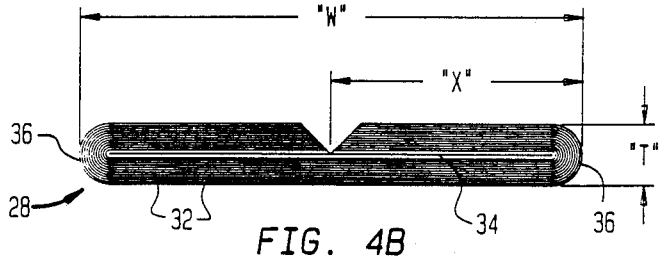
FIGS. 4A and 4B are schematic end views showing alternative constructions of the warp-free paperboard slat of the present invention.
Figure 4B:
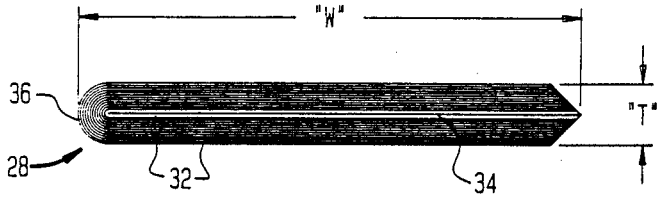
Figure 3:
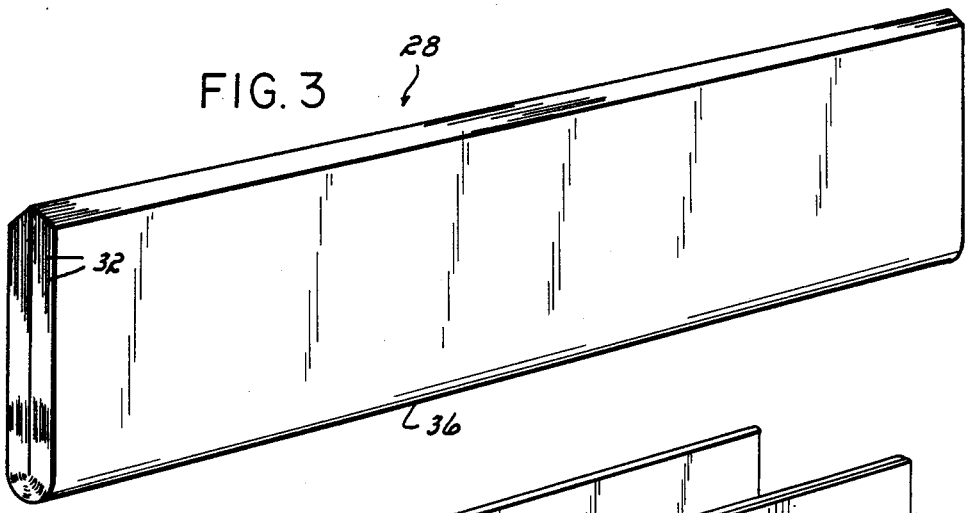
FIG. 3 is an isometric pictorial view illustrating the warp-free paperboard slat of the present invention.

Referring now to FIGS. 3 and 4A and 4B, the construction of the paperboard slat 28 of the present invention is shown in more detail. The slat is formed generally of an extended length by bringing together from multiple rolls sheets of paperboard and laminating them together with a suitable adhesive such as a sodium silicate slurry. The laminated sheets of paperboard are then folded along one or more fold lines 36 and the facing sheet fully pressed together such that the facing sheets are substantially co-extensive one with another. A suitable adhesive is used to join those sheets together to form the final article. When the adhesive is set the slats may then be cut of desired length. As described below, the thickness of the resulting slats is a function of the number and thickness of the paperboard plys, and the width is a function of the width of the webs of paperboard used to form the slats.

The paperboard slats may be formed of various configurations. Two alternatives are illustrated by FIGS. 4A and 4B, respectively. In each embodiment, multiple plies 32 of paperboard are laminated and glued together. This laminated paperboard is then folded upon itself and glued thereto along a line 34 to provide a slat having a width "W" and a thickness "T". As seen, the slat 28 has at least one rounded edge along the fold line 36 (FIG. 4B) or a pair of rounded edges along fold lines 36 (FIG. 4A). Although the slats 28 could be formed of a width "W" merely by laying up and laminating multiple plys of paperboard of width "W", it has been found that exceptional beam strength in the slat is provided by first forming the multiple plys and then folding the element upon itself and gluing it to itself along line 34. This fold gives the slat more strength using the same amount of paper than merely laminating multiple plys. Moreover the resulting product has been found to be surprisingly warp-free.

In FIG. 4A, the slat 28 is formed by folding two side edges of width "X" ("X" equalling "W"/2) and thickness "T"/2 together and laminating them to the center section to provide a overall width "W" and thickness "T". In a presently preferred form of the invention, the dimension "W" is on the order of ½" to 4" and the thickness "T" from about 0.040–0.050" to 0.40".

It has been found that the embodiment shown in FIG. 4A has certain advantages over that shown in 4B in that the double fold tends to lessen warpage and give a more even product. Additionally, in the embodiment shown in FIG. 4A, a single sheet of paperboard may be placed over the top surface to provide uniformity or the outer paperboard ply of one of the folded portions can be extended over the other folded portion.

The paperboard slat may be formed in several alternative fashions. One is to bring together a number of plies of paperboard from individual rolls, glue them together, press the members together, form the resulting product first into a right angle and then press the legs of the angle together with an adhesive therebetween to form the folded structure as shown in FIGS. 3 and 4A and 4B. In this operation, the adhesive joining the sheets together has not been permitted to dry such that the sheets of laminated paper may still slip one with another to permit the folding of the plies. In an alternative method of manufacture, the laminated plys may be first formed into a right angle. Thereafter, while again the adhesive is sufficiently moist to permit slippage of the plies that right angle can then be pressed in a separate operation to form the slat construction. In this method of manufacture, a hot melt adhesive has been used to secure the facing sheets on their folding together across their respective surfaces, the hot melt providing a relatively short open period whereby adhering of the facing sheets can be accomplished before the legs of the angle have an opportunity to separate.

Referring back to FIGS. 1 and 2, the paperboard slats 28 are laminated to the marginal side portions of the paperboard sheet 22 to form a peripheral frame 26 and to the side flaps 24. Preferably, the rounded edge 36 created on folding is disposed toward the hinge of the paperboard joining flaps 24 to sheet 22. As is known in the art, the tension applied to the straps 18 securing the load to the skid can be very high tending to cut into the load. The paperboard slats 28 having folded edges 36 at their apexes have been found to provide excellent resistance to strap indentation.

Figure 5:
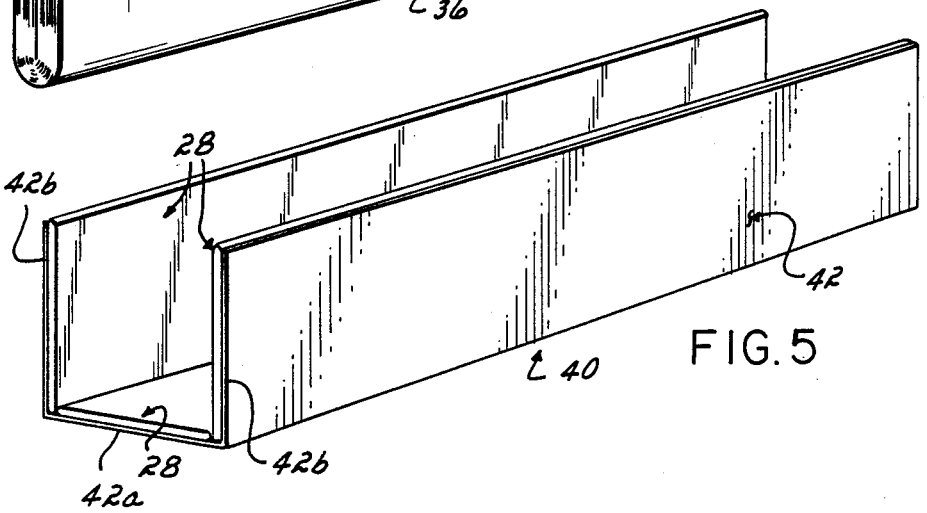
FIGS. 5 and 6A and 6B are pictorial views showing alternative uses of the warp-free paperboard slat of the present invention.

In another application shown in FIG. 5, it is desired to form a channel 40 for use in protecting the edge of a member to be packaged and shipped such as a door. In this application, a sheet of paperboard 42 has adhered to a central portion 42*a* and two side portions 42*b* the paperboard slats 28 of the present invention. Sufficient distance is maintained between the edges such that the member can be formed into the channel configuration shown in FIG. 5. The resulting structure is of relatively high strength and high rigidity and prevents the straps which pass around the door from cutting into the door edges. This again has been found to provide excellent resistance to strap indentation. Moreover, the channel 40 can be shipped flat for folding into the channel shape by the user. This results in a significant space savings in shipping.

Figure 6A:
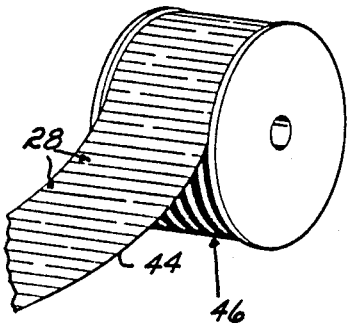
Figure 6B:
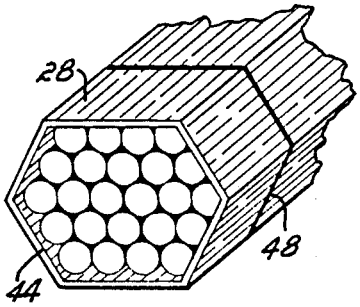

Referring now to FIG. 6, two alternative embodiments are shown. In FIG. 6A, the paperboard slats 28 are adhered to an underlying paperboard sheet 44 to provide a wrap for a coil of wire 46. The slats 28 provide a tough, compression-resistant, and highly abrasion and tear-free surface for the wrapping. In FIG. 6B, the wrapping shown in FIG. 6A is placed about a pack of rods and then secured by steel bands 48. As set forth above, the slats 28 prevent the bands from cutting through the wrap and provide the tough, compression-resistant, and highly abrasion and tear-free wrapping desired.

Thus having described the invention, what is claimed is:

1. A structural channel for use in protecting the edge of a product to be packaged or shipped comprising a sheet of paperboard and a central and two side slats adhered thereto, said slats comprising a plurality of sheets of paperboard laminated to each other and the paper laminate being folded upon itself along a fold line with the facing sheets being adhered together and having a rounded edge along the fold line.

2. A wrapping material for use in protecting product to be packaged or shipped comprising a sheet of paperboard and a plurality of paperboard slats adhered thereto in substantially edge abutting relation, said slats comprising a plurality of sheets of paperboard laminated to each other and the paper laminate being folded upon itself along a fold line with the facing sheets being adhered together and substantially overlapping one another to cause opposed planar faces along where it is laminated to itself, one of said opposed planar faces being laminated to said sheet of paperboard, and said slat having a rounded edge along the fold line.

* * * * *

UNITED STATES PATENT AND TRADEMARK OFFICE

CERTIFICATE OF CORRECTION

PATENT NO. : 4,898,279

DATED : February 6, 1990

INVENTOR(S) : Kent A. Linnemann

It is certified that error appears in the above-identified patent and that said Letters Patent is hereby corrected as shown below:

Col. 2, line 54, ".25" should be --.40--.

Signed and Sealed this

Twelfth Day of February, 1991

*Attest:*

HARRY F. MANBECK, JR.

*Attesting Officer*

*Commissioner of Patents and Trademarks*